US010251448B2

(12) United States Patent
Klug et al.

(10) Patent No.: US 10,251,448 B2
(45) Date of Patent: Apr. 9, 2019

(54) ARTICLE OF FOOTWEAR WITH MULTIPLE LAYERS

(71) Applicant: NIKE, Inc., Beaverton, OR (US)

(72) Inventors: Bryant Russell Klug, Beaverton, OR (US); Timothy K. Liles, II, Portland, OR (US); John S. MacGilbert, Tigard, OR (US); William C. McFarland, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 36 days.

(21) Appl. No.: 15/404,450

(22) Filed: Jan. 12, 2017

(65) Prior Publication Data

US 2017/0202311 A1 Jul. 20, 2017

(51) Int. Cl.

| | |
|---|---|
| ***A43B 23/02*** | (2006.01) |
| ***A43B 19/00*** | (2006.01) |
| ***A43B 23/07*** | (2006.01) |
| ***A43B 1/00*** | (2006.01) |
| ***A43B 1/04*** | (2006.01) |
| ***A43B 13/18*** | (2006.01) |
| ***A43B 13/32*** | (2006.01) |
| ***A43C 1/04*** | (2006.01) |

(52) U.S. Cl.

CPC ..... *A43B 23/0235* (2013.01); *A43B 1/0027* (2013.01); *A43B 1/04* (2013.01); *A43B 13/181* (2013.01); *A43B 13/187* (2013.01); *A43B 13/32* (2013.01); *A43B 19/00* (2013.01); *A43B 23/027* (2013.01); *A43B 23/0245* (2013.01); *A43B 23/0275* (2013.01); *A43B 23/07* (2013.01); *A43C 1/04* (2013.01)

(58) Field of Classification Search

CPC ..... A43B 23/0235; A43B 23/07; A43B 1/04; A43B 13/32; A43B 19/00; A43C 1/04

See application file for complete search history.

(56) References Cited

U.S. PATENT DOCUMENTS

| | | | | |
|---|---|---|---|---|
| 2009/0100713 | A1* | 4/2009 | Adami | A43B 3/0047 36/100 |
| 2012/0011744 | A1* | 1/2012 | Bell | A43B 1/0072 36/91 |
| 2013/0104422 | A1* | 5/2013 | Hatfield | A43B 5/001 36/103 |
| 2015/0257476 | A1 | 9/2015 | Panian et al. | |

FOREIGN PATENT DOCUMENTS

FR 3 001 616 A1 8/2014

OTHER PUBLICATIONS

International Search Report and Written Opinion in corresponding International Application No. PCT/US2017/013153, dated Apr. 6, 2017, 16 pages.

* cited by examiner

*Primary Examiner* — Ted Kavanaugh
(74) *Attorney, Agent, or Firm* — Brinks Gilson & Lione

(57) ABSTRACT

The present embodiments generally relate to an article of footwear with multiple layers. The article of footwear may include an inner layer with a void dimensioned for receipt of at least a portion of a foot. The article of footwear may also include an outer layer, where the outer layer at least partially surrounds the inner layer. A midsole may be disposed between the inner and outer layers, where the midsole is secured to the inner layer and the outer layer to thereby form an indirect coupling between the inner layer and the outer layer. The inner layer may be movable relative to the outer layer at one or more locations separate from the indirect coupling.

18 Claims, 5 Drawing Sheets

ARTICLE OF FOOTWEAR WITH MULTIPLE LAYERS

CROSS REFERENCE TO RELATED APPLICATIONS

This application claims priority to U.S. provisional application Ser. No. 62/279,458, filed Jan. 15, 2016, which is herein incorporated by reference in its entirety.

BACKGROUND

Conventional articles of footwear generally include two primary elements: an upper and a sole structure. The upper is secured to the sole structure and forms a void within the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel region of the footwear. A lacing system is often incorporated into the upper to adjust the fit of the upper, thereby permitting entry and removal of the foot from the void within the upper. In addition, the upper may include a tongue that extends under the lacing system to enhance adjustability of the footwear, and the upper may incorporate a heel counter to limit movement of the heel.

DESCRIPTION

The present embodiments generally relate to an article of footwear with multiple layers. The article of footwear may include an inner layer with a void dimensioned for receiving at least a portion of a foot. The article of footwear may also include an outer layer, where the outer layer at least partially surrounds the inner layer. A midsole may be disposed between the inner and outer layers, where the midsole is secured to the inner layer and the outer layer to thereby form an indirect coupling between the inner layer and the outer layer. The inner layer may be movable relative to the outer layer at one or more locations separate from the indirect coupling.

The inner layer may lack a direct attachment to the outer layer.

A first shape of the inner layer may not be proportionate to a second shape of the outer layer.

The first shape of the inner layer may include a first length along a longitudinal axis of the article of footwear, a first width generally transverse to the longitudinal axis, and a first ratio of the first length to the first width. The second shape of the outer layer may include a second length along the longitudinal axis, a second width generally transverse to the longitudinal axis, and a second ratio of the second length to the second width. The first ratio may be greater than the second ratio.

The article of footwear may have at least one tensile element secured to the inner layer and at least one aperture formed in the outer layer. The at least one tensile element may be disposed through the at least one aperture.

The outer layer may have at least one window for viewing of the inner layer.

At least one of the inner layer and the outer layer may include a void spot in an ankle region of the article of footwear to facilitate flexing of an ankle.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

Figure 1:
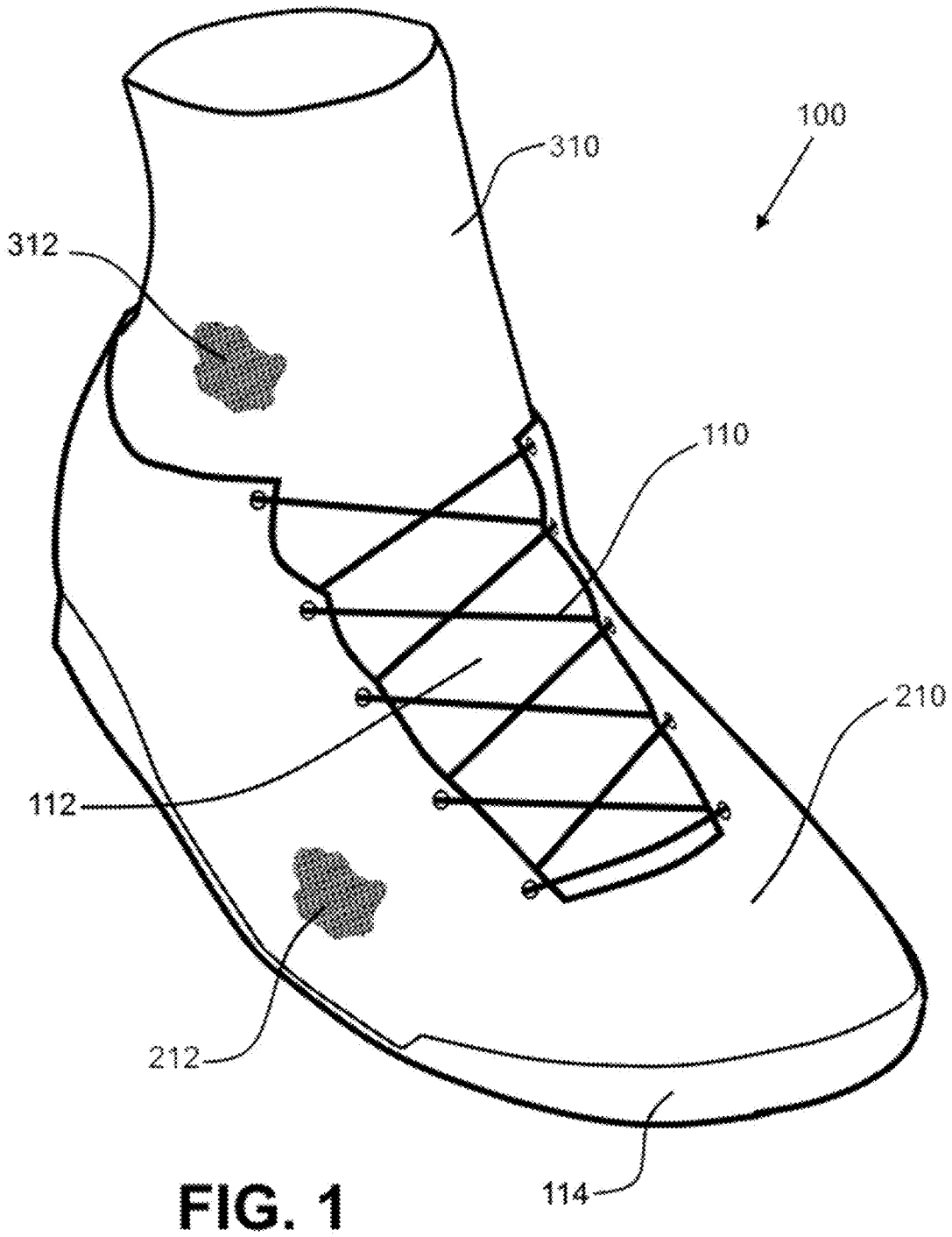
FIG. 1 shows a perspective view of an article of footwear with an outer layer and an inner layer.

The present embodiments generally relate to an article of footwear with multiple layers. Referring to FIG. 1, the article of footwear 100 may have an outer layer 210 and an inner layer 310. The outer layer 210 may at least partially surround the inner layer 310, as shown, and may be optionally secured to an outsole 114. A securement device, such as a lace 110 in throat area 112 of the article of footwear 100, may be provided to tighten the outer layer 210 and/or the inner layer 310 around the foot of a user. As used herein, the term "user" means a person wearing the article of footwear. In some embodiments, the outer layer 210 may be fully or at least partially formed from a textile or fabric component, depicted as knitted component 212. For example, the knitted component 212 of the outer layer 210 may be formed by a knitting process, such as a flat-knitting process, a circular-knitting process, or the like. The knitted component 212 may be treated (e.g., steamed or otherwise treated on a foot-shaped last) to achieve suitable characteristic (such as suitable) after the knitting process. In some embodiments, the knitted component 212 is formed during a single knitting process and without any seams. In other words, no sewing or other attachment step is required after the knitting process to form the knitted component 212. Advantageously, the lack of seams may create a stronger and more durable outer layer 210, as an area with a seam or other point of attachment is generally the weakest and least durable area of a component included in an article of footwear. Other suitable textile manufacturing processes may be used to form the outer layer 210 (e.g., weaving). In some embodiments, the outer layer 210 may be at least partially formed of a material other than a textile material (e.g., leather, plastic, rubber, or any other suitable material). The outer layer 210 may be configured to substantially surround the foot of a user, including at least a portion of the lateral and medial sides of the foot and at least a portion of the dorsal and plantar surfaces of the foot. The outer layer 210 may extend over the instep and toe areas of the foot, along the medial and lateral sides of the foot, and around the heel area of the foot. The outer layer 210 may further surround at least a portion of the user's ankle and/or shin.

Figure 3:
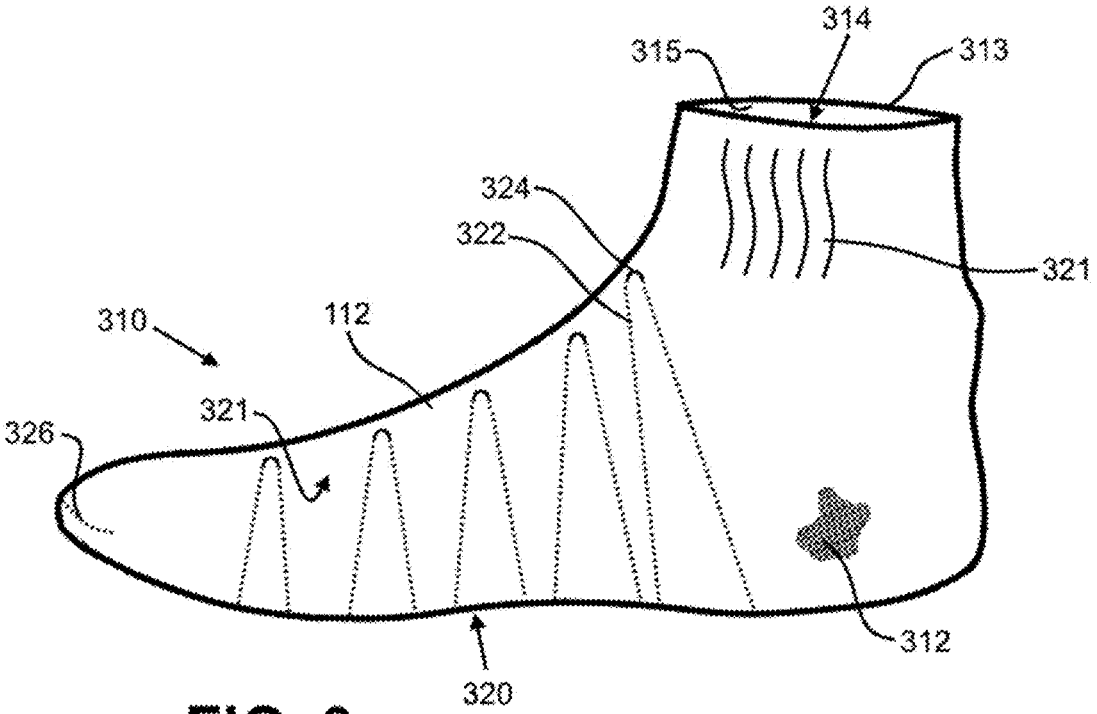
FIG. 3 shows a lateral side view of an embodiment of an inner layer for an article of footwear.

Similarly, the inner layer 310 may be at least partially formed from a textile or fabric component, depicted as knitted component 312. For example, the knitted component 312 of the inner layer 310 may be formed at least partially through a knitting process, such as a flat-knitting process, a circular-knitting process, or another suitable knitting process. The inner layer 310 may be knitted in a single knitted process and without any seams. Alternatively, the inner layer 310 may be configured such that any seams are located in areas of the inner layer 310 that generally do not experience a high degree of stress during normal use (e.g., at seam 326 in the toe area of the inner layer 310 as shown in FIG. 3). Other suitable textile manufacturing processes may be used (e.g., weaving). In some embodiments, the inner layer 310 may be at least partially formed of a material other than a textile material. The inner layer 310 may be configured to substantially surround the foot of a user, including at least a portion of the lateral and medial sides of the foot and at least a portion of the dorsal and plantar surfaces of the foot. The inner layer 310 may extend over the instep and toe areas of the foot, along the medial and lateral sides of the foot, and around the heel area of the foot of a user. The inner layer 310 may further surround at least a portion of a user's ankle and/or shin.

The inner layer 310 and the outer layer 210 may be made of different materials. For example, the inner layer 310 may be formed from a first material, and the outer layer 210 may be made from a second material, where at least a portion of the second material has a greater stretch resistance than the first material. This may be advantageous where it is desirable to have a compliant inner layer 310 to provide comfort and reduce friction between a user's foot and the article of footwear 100, but when the article of footwear 100 also optimally has a stable structure with sufficient rigidity. It is contemplated that one of the layers may be substantially formed of a knitted or other textile component, while the other of the layers is not.

Figure 2:
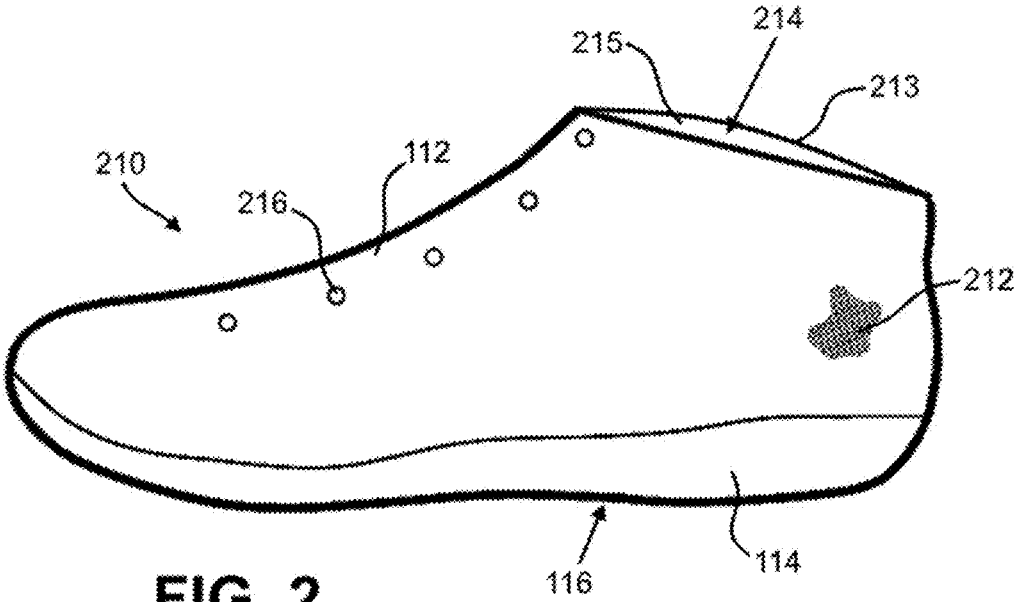
FIG. 2 shows a lateral side view of an embodiment of an outer layer for an article of footwear.

FIG. 2 shows a lateral side view of an embodiment of the outer layer 210 of the article of footwear 100. Referring to FIG. 2, the outer layer 210 may include void 214 configured to receive the inner layer 310 (shown in FIG. 1) and the foot of a user. The outer layer 210 may include an ankle opening 213, which is configured to allow the passage of the user's foot during insertion or removal of the foot from the void 214. An inner surface 215 may face the inner void 214. A plurality of apertures 216 may be formed in the outer layer 210 in the throat area 112, and in some embodiments may be formed specifically in the knitted component 212 of the outer layer 210 as shown. The apertures 216, for example, may be configured to receive a lace (e.g., shoelace) or another securement device configured to tighten the article of footwear 100 around a foot. Alternatively, or in addition, the apertures 216 may be configured to receive a loop of a tensile element, as described in detail below. The apertures 216 may be formed, for example, by cutting or punching a hole through the outer layer 210. In some embodiments, the apertures 216 may be integrally formed within the knitted component 212 during the knitting process without modifying the knitted component 212 in a post-knitting step. A grommet (not shown) may be included within the apertures 216 to prevent tearing, abrasion, and/or unraveling of the outer layer 210.

In some embodiments, the outer layer 210 may be attached to the outsole 114. The outsole 114 may be formed of a plastic, rubber, or other suitable material, and is attached to the outer layer 210 with an adhesive, with stitching, or with any other suitable attachment mechanism. The outsole 114 may have a ground-engaging surface 116 configured to contact the ground when the article of footwear 100 is in use. It is contemplated that the outsole 114 may include tread, cleats, or other features configured to suitably grip the ground. The outsole 114 may additionally provide cushioning and/or absorb contact force as a user walks, runs, or performs other activities while wearing the article of footwear 100.

In other embodiments, the outsole 114 may be integral with the outer layer 210. For example, it is contemplated that the knitted component 212 of the outer layer 210 may comprise yarns at least partially formed of a material that may act as tread on the ground-engaging surface 116 of the outsole 114, such as yarns coated with a rubber or plastic material. In some embodiments, the knitted component 212 includes fusible yarns, such as yarns comprising a thermoreactive material that changes state in response to heat (e.g., a thermopolymer or thermoplastic polymer that transitions from a solid state to a softened or liquid state when subjected to certain temperatures, including polyurethanes, polyesters, polyamides, polyolefins, nylons, and the like). These fusible yarns may form a relatively continuous, relatively ridged, and relatively durable tread on the outsole 114 after cooling and hardening from a heated, softened state.

Figure 4:
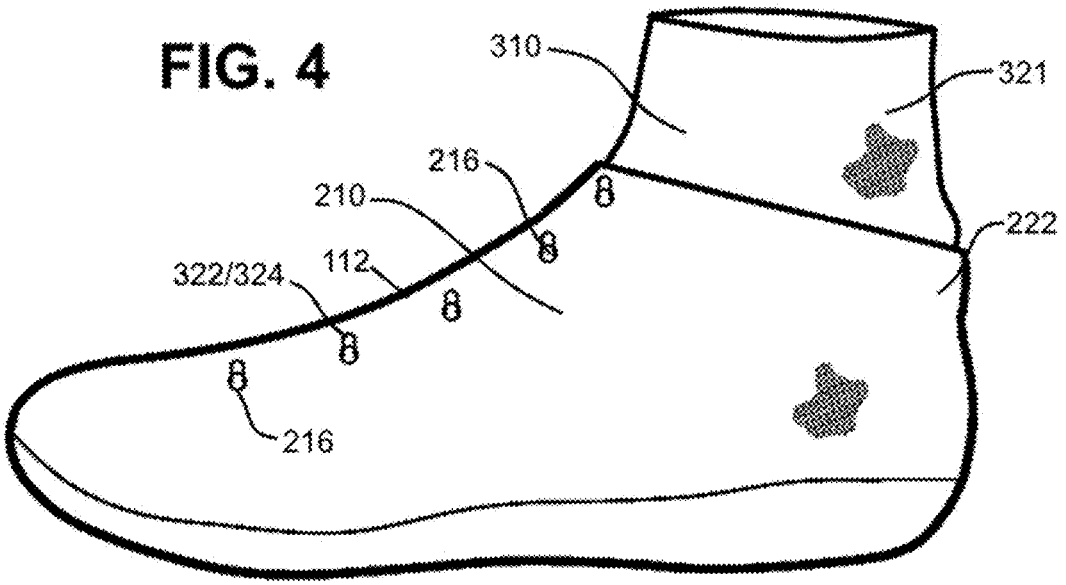
FIG. 4 shows a lateral side view of an article of footwear including the outer layer shown in FIG. 2 partially surrounding the inner layer shown in FIG. 3.

FIG. 3 shows a lateral side view of one embodiment of an inner layer 310 (for an article of footwear 100). The depicted inner layer 310 has a void 314 dimensioned to receive the foot of a user, along with an ankle opening 313 configured to allow the passage of the user's foot during insertion or removal of the foot from the void 314. An inner surface 315 may be configured to contact the skin of a user (e.g., near the user's ankle). Accordingly, the inner surface 315 may be configured to be smooth or soft to the touch (by, for example, knitting the inner layer 312 such that a relatively soft yarn is exposed on the inner surface 315). In some embodiments, the characteristics of the inner surface 315 are optimized for contact with a sock worn by a user. An outer surface, and particularly a bottom surface 320, may be configured to attach to another element of the article of footwear 100 to thereby retain the inner layer 310 within the first void 214 of the outer layer 210 (as shown in FIG. 4).

As depicted by FIG. 3, an ankle area 321 of the inner layer 312 may have a high degree of elasticity or stretchiness. This may be achieved by, for example, a certain knit construction of the knitted component 312 (e.g., a knitted rib structure) and/or the type of yarn used (e.g., a relatively elastic nylon yarn). This feature may provide a relatively tight and comfortable fit around a user's ankle and/or shin while also allowing a user to put on and take off the article of footwear 100 relatively easily.

While not shown, the inner layer 310 may have a plurality of apertures, which may be configured to receive the lace or other securement. As described above with respect to the outer layer 210 (with reference to FIG. 2), the apertures in the inner layer 310 may be formed in the knitted component 312 near the throat area 112. As described above, the apertures may be formed, for example, by cutting or punching a hole through the inner layer 310 or integrally forming them with the knitted component 312 of the inner layer 310 during the knitting process.

As depicted in FIG. 3, the inner layer 310 may include a plurality of tensile elements 322. The tensile elements 322 can be incorporated within the knitted component 312. For example, the tensile elements 322 can be inlaid within one or more courses or wales of the knitted component 312 during the knitting process of the knitted component 312. The tensile elements 322 may provide stretch resistance to respective areas of the inner layer 310. The tensile elements 322 can be included in any suitable area of the inner layer 310. In some embodiments, the inner layer 310, the knitted component 312, and/or the tensile elements 322 can incorporate the teachings of "Article of Footwear Having An Upper Incorporating A Knitted Component," filed on Dec. 18, 2008 and published as U.S. Patent Application Publication Number 2010/0154256 on Jun. 24, 2010, and/or U.S. patent application Ser. No. 13/048,514 to Huffa et al., entitled "Article Of Footwear Incorporating A Knitted Component," filed on Mar. 15, 2011 and published as U.S. Patent Application Publication Number 2012/0233882 on Sep. 20, 2012, both of which applications are hereby incorporated by reference in their entirety.

The tensile elements 322 can turn at a location adjacent to the throat area 112 to form a plurality of loops 324. The loops 324 may be located on both the medial and lateral sides of the throat area 112 (or anywhere else on the inner layer 310). In some embodiments, a single tensile element 322 extends around substantially the entirety of the inner layer 310 to form a loop 326 on both the medial and lateral sides of the throat area 112. While not shown, the outer layer 210 may additionally or alternately include tensile elements (with or without loops).

Figure 5:
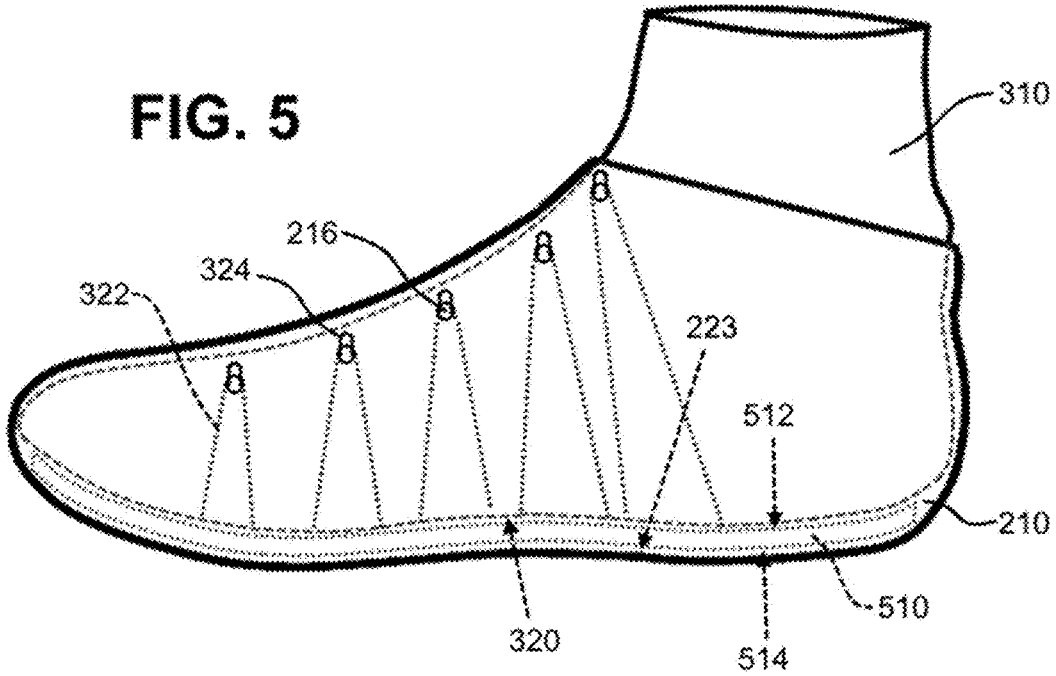
FIG. 5 shows a lateral side view, including dashed lines depicting certain hidden features, of the article of footwear depicted in FIG. 4.

The loops 324 may extend from the outer surface 321 of the inner layer 310, and may be configured to receive a lace or other securement device of the article of footwear 100. As described in more detail below, the loops 324 may align with and/or be disposed through the apertures 216 of the outer layer 210 (as shown in FIGS. 4-5). In embodiments where the inner layer 310 has apertures in the throat area 112 (not shown), it is contemplated that the tensile elements 322 could surround the apertures while inlaid within the knitted component 312 (e.g., without extending from the outer surface 321), and/or the loops 324 may be formed adjacent to the apertures such that the apertures of the inner layer 310 and the loops 324 of the inner layer 310 are both configured to receive a lace or other securement device together.

FIG. 4 shows a lateral side view of the article of footwear 100 including the outer layer 210 from FIG. 2 partially surrounding the inner layer 310 from FIG. 3. As depicted, the loops 324 of the tensile elements 322 are at least approximately aligned with the apertures 216 of the outer layer 210. Here, the loops 324 of the tensile elements 322 are additionally disposed through the apertures 216. While not shown, a lace or other securement device may run through the loops 324, and may act only on the loops 324 to tighten both the outer layer 210 and the inner layer 310 around the foot of a user. In another embodiment, the loops 324 may be located underneath the outer layer 210, and/or a lace may extend through the loops 324 and the apertures 216 together (as generally shown in FIG. 1).

As depicted in FIG. 4, the ankle area 321 of the inner layer 310 may extend higher than the ankle area 222 of the outer layer 210. Advantageously, this embodiment may provide a user with coverage over his or her ankle and/or lower shin by the inner layer 310, thereby providing the ankle or lower shin with cushioning, support, and a comfortable fit. In this embodiment, the outer layer 210, which may be made of a more ridged material and/or may be treated for strength and/or rigidity, does not cover the ankle or lower shin of the user, and therefore does not inhibit the movement of that area of the body. It is contemplated that, in other embodiments, the outer layer 210 and the inner layer 310 may have substantially the same height and therefore terminate at approximately the same area of a user's foot, ankle, and/or shin. Alternatively, the ankle area 222 of the outer layer 210 may extend to a higher level than the ankle area 321 of the inner layer 310. This embodiment may be advantageous, for example, when cushioning and protection of the ankle is desired, but it is not desirable for the article of footwear 100 to provide a tight fit around the ankle or shin of a user.

FIG. 5 shows the article of footwear 100 of FIG. 4 (without a separate outsole) with dashed lines depicting the hidden features. A midsole 510 is depicted in FIG. 5 as disposed between the inner layer 310 and the outer layer 210. As shown, the bottom surface 320 of the inner layer 310 is adjacent to a top surface 512 of the midsole 510, and a top surface 223 of the outer layer 210 is adjacent to a bottom surface 514 of the midsole 510. In one non-limiting example, the midsole 510 may be at least partially formed of a polymer foam material that attenuates ground reaction forces to thereby lessen stresses upon the foot and leg during walking, running, etc. The midsole 510 may be made of any other suitable material (plastic, metal, rubber, etc.).

In some embodiments, the midsole 510 is secured to the inner layer 310 and the outer layer 210, thereby forming an indirect coupling between the inner layer 310 and the outer layer 210. The inner layer 310 may be movable relative to the outer layer 210 at one or more locations separate from the indirect coupling formed through the midsole 510. In some embodiments, the inner layer 310 may lack a direct attachment to the outer layer 210.

The midsole 510 may be secured to the inner layer 310 and the outer layer 210 in a variety of ways. For example, the midsole 510 may be secured to the inner layer 310 and/or the outer layer 210 with an adhesive (e.g., a cement-based adhesive or another suitable type), with stitching, or with any other suitable mechanism of securement. It is contemplated that the midsole 510 could be secured to the inner layer 310 in a different way than it is secured to the outer layer 210. Further, in some embodiments, the midsole 510 may be free (e.g., not secured) with respect to one or both of the outer and inner layers 210 and 310.

As shown in FIG. 5 (and as described in more detail above), the loops 324 formed by the tensile elements 322 of the inner layer 310 are aligned (or at least approximately aligned) with and are disposed through the apertures 216 of the outer layer 210. In some embodiments, the inner layer 310 is only coupled to the outer layer 210 by the one more tensile elements 322 extending through the apertures 216 (though this is not required in all embodiments). Advantageously, these embodiments allow both the outer layer 210 and the inner layer 310 to be tightened around the foot of a user using only one lace or securement device in communication with the tensile elements 322. Further, in some instances, it may be desirable for the inner layer 310 to be relatively loosely coupled to the outer layer 210 such that at least one portion of the inner layer 310 is movable with respect to the outer layer 210. When the inner and outer layers 310 and 210 are only coupled at the apertures 216, a large percentage of the inner layer 310 will be movable with respect to the outer layer 210. This may provide comfort, reduce friction between a user's foot and the article of footwear 100, and provide a user an enhanced ability to quickly change lateral directions.

Figure 6:
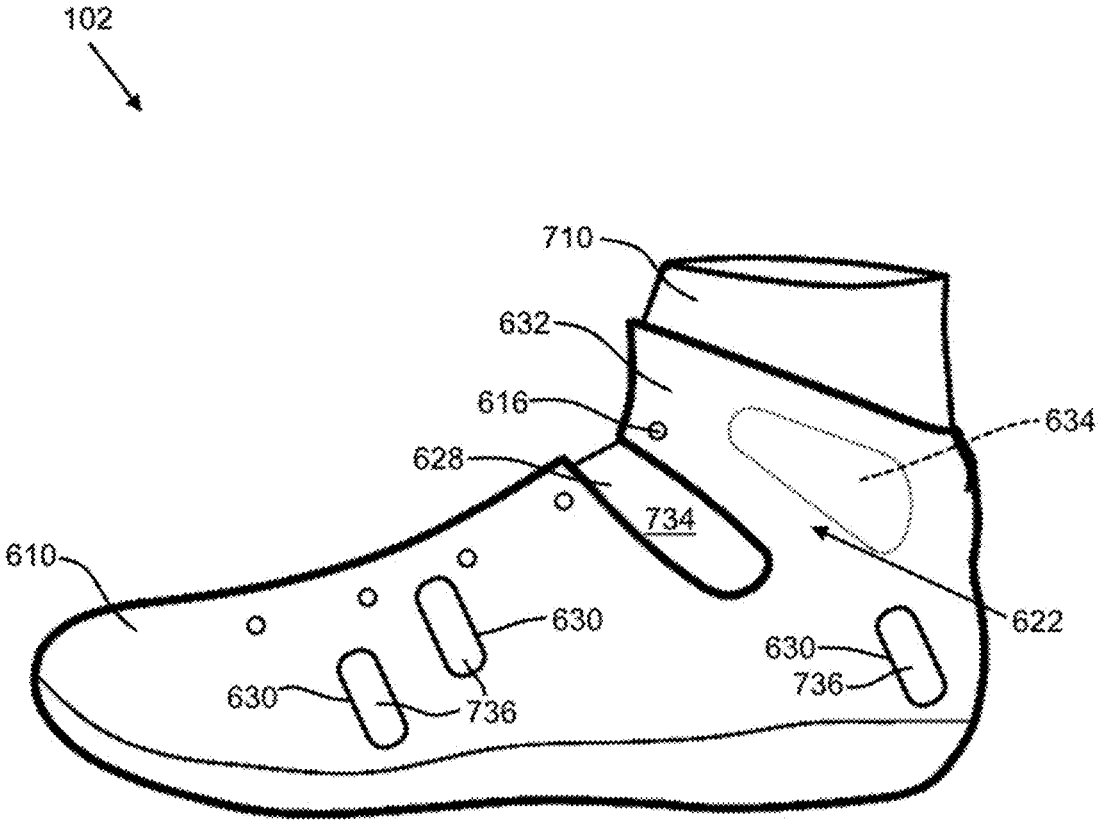
FIG. 6 shows a lateral side view of another embodiment of an outer layer for an article of footwear.

FIG. 6 shows a lateral side view of an article of footwear 102 with an outer layer 610 and an inner layer 710. As shown, the outer layer 610 has a void spot 628 in the ankle region 622. The void spot 628 may provide flexibility adjacent to the front (anterior) of the ankle joint of a user to facilitate flexing of the ankle. In embodiments not shown, a void spot may alternatively or additionally be formed in the inner layer 710. A protrusion 632 in the ankle area 622 of the outer layer 610 may extend adjacent to the void spot 628 and may be configured to cover the ankle of a user. The protrusion 632 may have one or more apertures 616 configured to communicate with a lace or other securement device to tighten the protrusion around the foot, ankle, or leg of a user. It is contemplated that the inner layer 710 and/or the outer layer 610 may comprise a tensile element wrapping around the ankle, as taught by U.S. patent application Ser. No. 13/686,048 to Podhajny et al., entitled "Knitted Footwear Component With An Inlaid Ankle Strand," filed on Nov. 27, 2012 and published as U.S. Patent Application Publication Number 2013/0145652 on Jun. 13, 2013, which is hereby incorporated by reference in its entirety.

A padded area 634 may be provided in the ankle area 622 and at least partially on the protrusion 632. It is noted that padded areas may be placed at any suitable location on either the outer layer 610 or the inner layer 710. The padding of the padded area 634 may be secured within a pocket formed in the outer layer 610, for example within a pocket integrally formed within a knitted element (such as knitted element 212 described above).

The outer layer 620 may further include windows 630, which may provide for the viewing of the areas of inner layer 710 located inside the cavity of the outer layer 610. To illustrate, in FIG. 6, several areas 736 of the inner layer 710 are aligned with the windows 630 of the outer layer 610. In some embodiments, the visual appearance of the inner layer 710 is different than the visual appearance of the outer layer 610. Advantageously, viewing the areas 736 of the inner layer 710 through the windows 630 may provide an aesthetically-appealing visual contrast. Similarly, area 734 of the inner layer 710 may be viewable through the void space 628 of the outer layer 610. This visual effect may be particularly noticeable when inner layer 710 has a finish that is multicolored, textured, marbled, striped, or any other non-continuous finish. Because, as described above, the inner layer 710 may be at least partially movable with respect to the outer layer 610, providing non-continuous visual properties on the inner layer 710 may achieve a dynamic (e.g., moving) visual effect when the user walks, runs, or performs other movements or activities. For example, when the inner layer 710 is multicolored, some colors will appear and/or disappear from observation through the windows 630 when article of footwear 102 flexes and moves the inner layer 710 with respect to the outer layer 610.

Figure 7A:
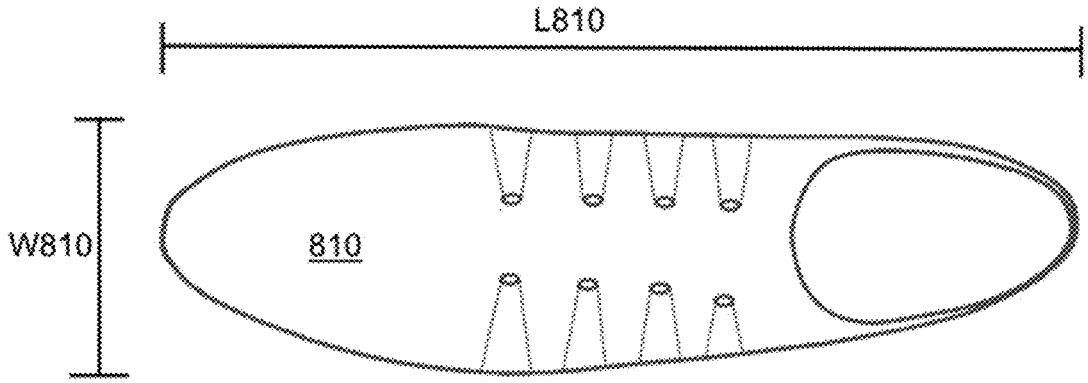
FIG. 7A shows a top view of an inner layer for an article of footwear.
Figure 7B:
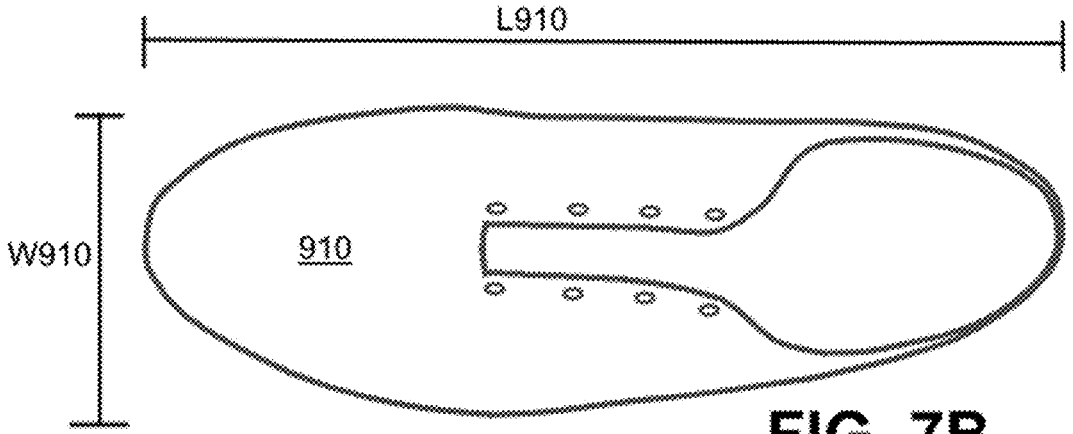
FIG. 7B shows a top view of an outer layer for an article of footwear.
Figure 7C:
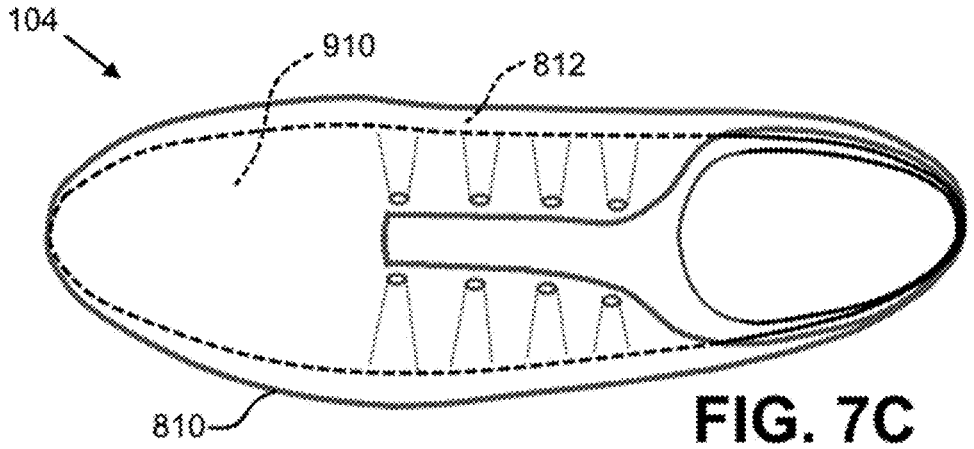
FIG. 7C shows a top view of an article of footwear including the outer layer of FIG. 7B partially surrounding the inner layer of FIG. 7A.

Referring to FIG. 7A-C, the shape of an inner layer 810 may not be proportionate with the shape of an outer layer 910. In FIG. 7A, the inner layer 810 (shown in isolation) may have a first shape with a first length L810 along a longitudinal axis of the article of footwear 104. The first shape of the inner layer 810 may also include a first width W810 generally transverse to the longitudinal axis. A first ratio of the inner layer 810 may be defined as the ratio of the first length L810 to the first width W810 (i.e., L810:W810).

Similarly, referring to FIG. 7B, the outer layer 910 may have a second shape with a second length L910 along the longitudinal axis of the article of footwear 104. The second shape of the outer layer 910 may also include a second width W910 generally transverse to the longitudinal axis. A second ratio of the outer layer 910 may be defined as the ratio of the second length L910 to the second width W910 (i.e., L910:W910).

In some embodiments of the article of footwear 104, the first ratio corresponding to the inner layer 810 and the second ratio corresponding to the outer layer 910 are different. For example, the first ratio corresponding to the inner layer 810 may be greater than the second ratio corresponding to the outer layer 910. In other words, the inner layer 810 may be narrower with respect to its length than the outer layer 910. This is particularly illustrated in FIG. 7C, which shows the article of footwear 104 having the inner layer 810 partially surrounded by the outer layer 910. This feature may be achieved, for example, by knitting the inner layer 810 to be smaller than the outer layer 910, and/or by treating the inner layer 810 and the outer layer 910 on different lasts during a post-knitting treatment step (e.g., a steaming step). As a result, a space or gap 812 may occur within the void of the outer layer 910. Advantageously, this may provide a user with an enhanced ability to quickly change lateral directions when engaging in athletic activities while still providing necessary support, comfort, and tight fit in the toe and heel areas of the foot. It is contemplated that, in some embodiments, the inner layer 910 may be stretchable such that the gap 812 is diminished (or even substantially eliminated) when a user places his or her foot in the article of footwear 104.

The present embodiments have been described in relation to particular examples, which are intended in all respects to be illustrative rather than restrictive. Alternative embodiments will become apparent to those of ordinary skill in the art to which the present embodiments pertain. Certain features and subcombinations are of utility and may be employed without reference to other features and subcombinations and are contemplated within the scope of the claims.

We claim:

1. An article of footwear, comprising:

an inner layer comprising a void dimensioned for receipt of at least a portion of a foot;

an outer layer, wherein the outer layer at least partially surrounds the inner layer; and a midsole disposed between the inner and outer layers, wherein the midsole is secured directly to the inner layer, and wherein the midsole is free from the outer layer, such that the inner layer and the outer layer lack direct securement by the midsole, wherein the inner layer is movable relative to the outer layer at the midsole.

2. The article of footwear of claim 1, wherein the inner layer is secured to the midsole with at least one of an adhesive and stitching.

3. The article of footwear of claim 1, wherein a first shape of the inner layer is not proportionate to a second shape of the outer layer.

4. The article of footwear of claim 3, wherein:

the first shape of the inner layer comprises a first length along a longitudinal axis of the article of footwear, a first width generally transverse to the longitudinal axis, and a first ratio of the first length to the first width;

the second shape of the outer layer comprises a second length along the longitudinal axis, a second width generally transverse to the longitudinal axis, and a second ratio of the second length to the second width; and wherein the first ratio is greater than the second ratio.

5. The article of footwear of claim 1, further comprising:

at least one tensile element secured to the inner layer; and at least one aperture formed in the outer layer, wherein the at least one tensile element is disposed through the at least one aperture.

6. The article of footwear of claim 1, wherein the outer layer comprises at least one window for viewing of the inner layer.

7. The article of footwear of claim 1, wherein at least one of the inner layer and the outer layer comprises a void spot in an ankle region of the article of footwear to facilitate flexing of an ankle.

8. An article of footwear, comprising:

an inner layer forming a void dimensioned for receipt of at least a portion of a foot; and an outer layer, wherein the outer layer at least partially surrounds the inner layer, wherein a first shape of the inner layer is not proportionate to a second shape of the outer layer, the first shape of the inner layer comprises a first length along a longitudinal axis of the article of footwear, a first width generally transverse to the longitudinal axis, and a first ratio of the first length to the first width;

the second shape of the outer layer comprises a second length along the longitudinal axis, a second width generally transverse to the longitudinal axis, and a second ratio of the second length to the second width; and wherein the first ratio is greater than the second ratio.

9. The article of footwear of claim 8, further comprising:

at least one tensile element secured to the inner layer; and at least one aperture formed in the outer layer, wherein the at least one tensile element is disposed through the at least one aperture.

10. The article of footwear of claim 9, wherein the inner layer is only coupled to the outer layer by the at least one tensile element being disposed through the at least one aperture.

11. The article of footwear of claim 8, further comprising a midsole disposed between the inner and outer layers and secured to the inner layer via at least one of an adhesive an stitching.

12. The article of footwear of claim 11, wherein the midsole is movable relative a bottom side of the outer layer, such that the inner layer and the outer layer lack direct securement by the midsole.

13. The article of footwear of claim 12, wherein the midsole is at least partially formed of a polymer foam material that attenuates ground reaction forces when the article of footwear is in use.

14. The article of footwear of claim 8, wherein the inner layer lacks a direct coupling to the outer layer.

15. The article of footwear of claim 8, wherein the outer layer comprises at least one window for viewing of the inner layer.

16. The article of footwear of claim 8, wherein at least one of the inner layer and the outer layer comprises a void spot in an ankle region of the article of footwear to facilitate flexing of an ankle.

17. The article of footwear of claim 8, wherein the inner layer is formed from a first material and the outer layer is formed from a second material, wherein at least a portion of the second material comprises greater stretch resistance than the first material.

18. The article of footwear of claim 1, wherein the midsole is at least partially formed of a polymer foam material that attenuates ground reaction forces when the article of footwear is in use.

* * * * *